US008087746B2

(12) United States Patent
Ray

(10) Patent No.: US 8,087,746 B2
(45) Date of Patent: Jan. 3, 2012

(54) MOVABLE FLUID RECEIVER

(75) Inventor: Paul C. Ray, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 620 days.

(21) Appl. No.: 12/251,985

(22) Filed: Oct. 15, 2008

(65) Prior Publication Data

US 2009/0122106 A1 May 14, 2009

Related U.S. Application Data

(60) Provisional application No. 60/987,025, filed on Nov. 9, 2007.

(51) Int. Cl.
*B41J 2/165* (2006.01)

(52) U.S. Cl. ..... 347/35

(58) Field of Classification Search ..... None
See application file for complete search history.

(56) References Cited

U.S. PATENT DOCUMENTS

| | | | | |
|---|---|---|---|---|
| 5,291,227 | A | 3/1994 | Suzuki | |
| 5,896,143 | A | 4/1999 | Matsui et al. | |
| 6,017,111 | A | 1/2000 | Kurata | |
| 6,276,778 | B1 | 8/2001 | Katayama | |
| 6,345,878 | B1 | 2/2002 | Kanaya et al. | |
| 6,619,783 | B2 | 9/2003 | Kanaya et al. | |
| 6,709,088 | B2 | 3/2004 | Hayakawa et al. | |
| 6,739,695 | B2 | 5/2004 | Yoshimura et al. | |
| 6,761,430 | B2 | 7/2004 | Kinoshita | |
| 6,932,456 | B2 | 8/2005 | Kanaya et al. | |
| 6,991,314 | B2 | 1/2006 | Hayakawa et al. | |
| 2003/0193541 | A1 | 10/2003 | Uwagaki et al. | |
| 2004/0046829 | A1 | 3/2004 | Taguchi et al. | |
| 2004/0135843 | A1 | 7/2004 | Hayakawa et al. | |
| 2007/0132799 | A1 * | 6/2007 | Ilda | 347/16 |
| 2007/0211105 | A1 * | 9/2007 | Furukawa | 347/45 |

* cited by examiner

*Primary Examiner* — Stephen Meier
*Assistant Examiner* — Alexander C Witkowski

(57) ABSTRACT

A printer and method include a first receiver configured to receive fluid ejected by one or more print heads on a first side of a media and a second receiver configured to receive fluid ejected by the one or more print heads on a second side of the media, wherein the second receiver is movable relative to the first receiver.

20 Claims, 6 Drawing Sheets

MOVABLE FLUID RECEIVER

CROSS-REFERENCE TO RELATED PATENT APPLICATIONS

The present application claims party under 35 USC 119 from U.S. Provisional Application Ser. No. 60/987,025 filed on Nov. 9, 2007 by Paul C. Ray and entitle MOVABLE FLUID RECEIVER. The present application is related to U.S. provisional patent application ser. no. 60/987,020 filed on the same day herewith by Paul Ray, Jennifer Marie McCord Brister, Jack Overway and William R. James and entitled PRINT HEAD SERVICE SHUTTLE, the full disclosure of which is hereby incorporated by reference. The present application is related to U.S. provisional patent application ser. no. 60/987,020 filed on the same day herewith by Paul Ray, Neil Doherty, Mun Yew Lee, Thomas J. Tarnacki and John W. Godden and entitled WEB FLOW PATH, the full disclosure of which is hereby incorporated by reference.

BACKGROUND

Different print media may have different widths. As a result, less than all of the nozzles of a print head may be used to print an image upon the media. The unused nozzles may reach an unhealthy state more quickly.

DETAILED DESCRIPTION OF THE EXAMPLE EMBODIMENTS

Figures 1, 2, 3:
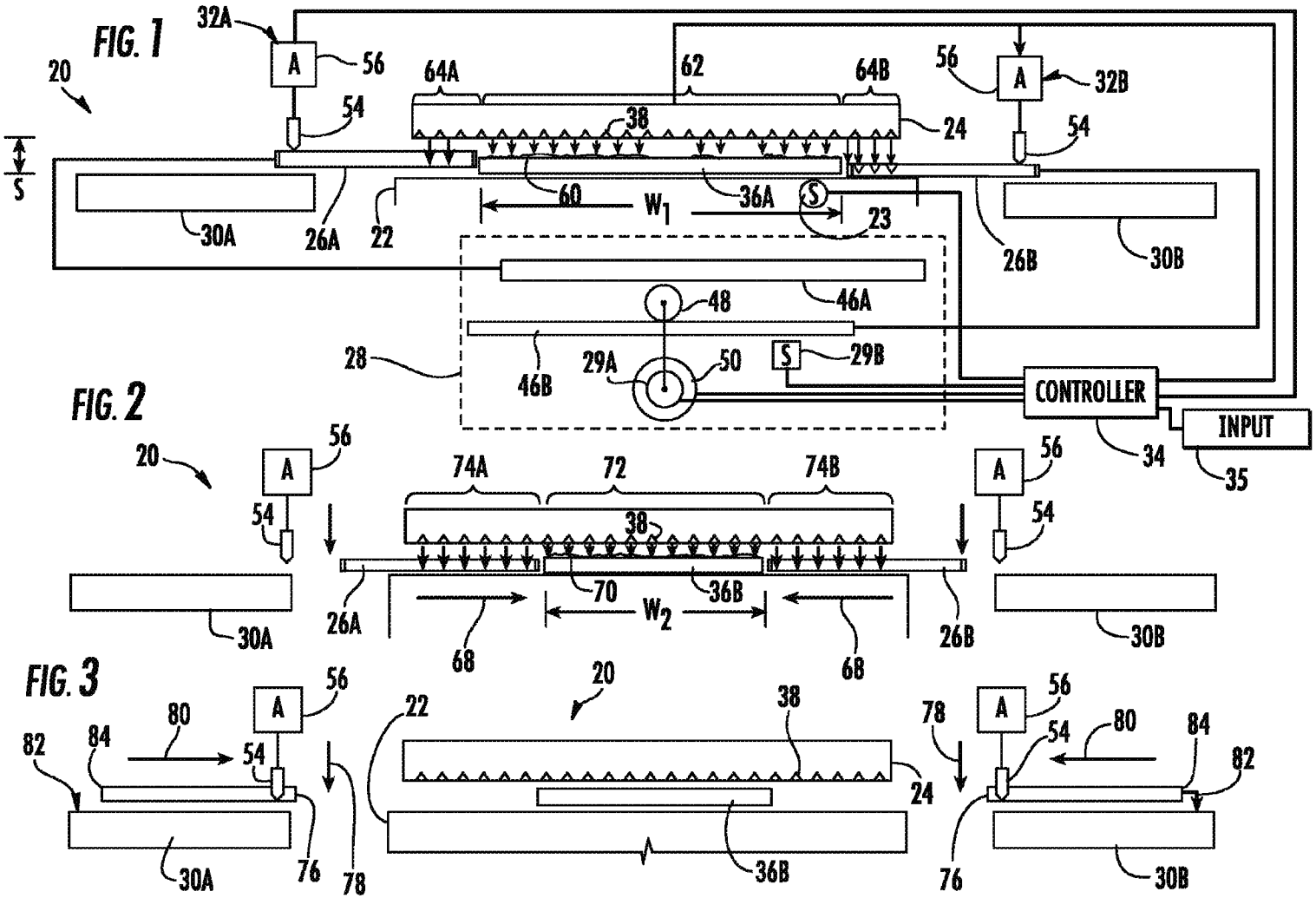
FIG. 1 is a sectional view schematically illustrating a printer printing upon a first medium according to an example embodiment.
FIG. 2 is a sectional view schematically illustrating the printer of FIG. 1 printing upon a second medium according to an example embodiment.
FIG. 3 is a sectional view schematically illustrating the printer of FIG. 1 during wiping receivers according to an example embodiment.

FIG. 1 is a sectional view schematically illustrating printer 20 according to an example embodiment. As will be described hereafter, printer 20 maintains nozzle health by facilitating spitting of ink or other fluid from unused nozzles during printing of an image. Printer 20 further facilitates borderless printing on media having different widths. As shown by FIG. 1, printer 20 generally includes media feed or media support 22, media sensors 23, one or more print heads 24, spittoons or receivers 26A, 26B (collectively referred to as receivers 26), receiver drive 28, sensors 29A, 29B (collectively referred to as sensors 29), collectors 30A, 30B (collectively referred to as collectors 30) and wipers 32A, 32B (collectively referred to as wipers 32) and controller 34.

Media feed or media support 22 comprises a structure or mechanism configured to support, move and position a print medium substantially opposite to the one or more print heads 24. FIG. 1 illustrates media support 22 positioning a first medium 36A, having a first width W1, opposite to the one or print heads 24. FIGS. 2 and 3 illustrate media support 22 positioning a second medium 36B, having a second lesser width W2, opposite to the one or more print heads 24. For purposes of this disclosure the term "width" when referring to media refers to a dimension of the medium generally perpendicular to a direction of travel of the medium when the media is moved opposite to the one or more print heads 24. As will be described hereafter, printer 20 maintains nozzle health by facilitating ejection of ink or other fluid from those nozzles not opposite to medium 36A or medium 36B during printing of an image upon medium 36A, 36B.

According to one embodiment, media support 22 may comprise one or more sets of rollers configured to move a web of media opposite to the one or more print heads 24. In one embodiment, media support 24 may comprise one more sets of rollers configured to move a sheet of media across a platen opposite to one or more print heads 24. In another embodiment, media support 22 may comprise a drum configured to carry and rotate sheets of media about an axis to position opposite to the one or more print heads 24. In still another embodiment, media support 24 may comprise a belt or a shuttle tray configured to position sheets of media opposite to the one or more print heads 24. In still other embodiments, media support 24 may have other configurations.

In a particular moderate illustrated, media support 22 supports a medium, such as a Web of media, at a centered position with respect to print heads 24. In other embodiments, media support 22 may support a medium at an off-centered position relative to print heads 24 such as when the media has a whit less than the width of print heads 24. In particular embodiment, the positioning of the media upon media support 22 may be adjustable.

Media sensors 23 comprise one or more sensors configured to detect and identify to controller 34 a width of the media supported by media support 22. In one embodiment, media centers 23 (schematically illustrated) may comprise one or more optical sensors (emitter-detector sensors). In another embodiment, sensors 23 may include triggers, flags or other sensing elements. Although illustrated as being located approximately print heads 24, media sensors 23 may alternatively be located upstream of print heads 24 so as to detect a width of media prior to the media reaching print heads 24. In one embodiment, sensors 23 may comprise sensors associated with a web guide to detect the position of the paper. The guides steer the web based on the web position detected by the sensors. Signals from such sensors 23 may be used by controller 34 to also adjust or reposition receivers 26, reducing cost and complexity of 20. In yet another embodiment, media sensors 23 may be omitted. For example, in some embodiment, controller 34 may receive data or information regarding a width of the media via an operator input 35 (schematically shown) such as a keyboard, keypad, mouse, touchpad, touch screen, microphone and speech recognition software, button, slide, switch and the like.

The one or more print heads 24 include a multitude of nozzles 38 through which ink or other fluid is ejected onto a print medium, such as medium 36A or 36B to form an image upon the medium. For purposes of this disclosure, the term "image" means any controlled pattern, arrangement or layout of the ink or fluid. Examples of images include graphics, photos, drawings and text (alphanumeric symbols).

In one embodiment, print heads 24 may comprise a single print head or multiple print heads supported along a single support structure or print bar. In another embodiment the one or more print heads 24 may comprise a series of print heads (staggered or unstaggered) or a series of print bars, each print bar including a series of staggered or unstaggered print heads. In one embodiment, the one or more print heads 24 may be substantially planar. In another embodiment, the one or more print heads 24 may be supported in an arc, such as when media support 22 also supports a medium in an arc opposite to the one or more print heads 24.

According to one embodiment, print heads 24 are fixed or stationary with respect to media support 22 in a direction substantially parallel to media support 22 such as fixed against movement either the left or to the right as seen in FIG. 1. In such an embodiment, print heads 24 may be movable in a direction substantially perpendicular to media support 22 or may also be fixed against movement in directions substantially perpendicular to media support 24 (up and down as seen in FIG. 1). In some embodiments, media support 24 may be configured to be scanned across the media.

Receivers 26 comprise one or more structures configured to receive and collect ink or other fluid ejected from nozzles 38 of print heads 24. In one embodiment, receivers 26 may comprise basins having a floor and one or more sidewalls that collect the ejected fluid. In another embodiment, receivers 26 may additionally include absorptive material within or on the basin for absorbing the received fluid. Examples of absorptive material include a foam, sponge, fabric or porous material.

In yet other embodiments, receivers 26 may consist of blocks, pads or other structures of the absorbent material alone. For example, in one embodiment, receivers 26 may comprise pads, blocks or structures of a fabric, sponge or foam material. In addition to receiving ink or fluid ejected from some of nozzles 38 of print heads during printing, the bottom side of such receivers 26 may also contact portions of media support 22 when being moved relative to media support 22 or during movement of media support 22 relative to receivers 26 during printing to wipe or remove residue ink or other fluid that may have collected upon media support 22. Such ink may have collected upon media support 22 during borderless printing.

Receivers 26A and 26B are substantially located on opposite sides of media support 22 and proximate to opposite sides of print heads 24. Receivers 26 are configured to fit between media support 22 and print heads 24. In one embodiment, receivers 26 are configured to be positioned between media support 22 and print heads 24 during printing of an image upon the medium supported by media support 22. According to one embodiment, during printing, print heads 24 are spaced from media support 22 by a spacing S, wherein receivers 26 each have a height less than a spacing S. In one embodiment, print heads 24 are spaced from media support 22 by about 2 mm, wherein receivers 26 have a height of less than or equal to about 2 mm. Because print heads 24 are relatively close to medium 36, image quality may be enhanced. Moreover, because receivers 26 are in close proximity to print heads 24, receivers 26 capture and collect the fluid drops before the drops lose their kinetic energy and become aerosol. As a result, less ink or other fluid is deposited upon unintended areas a printer 20. In other embodiments, the spacing S and the height of receivers 26 may be greater.

As illustrated by FIGS. 1 and 2, receivers 26 are each movably supported relative to media support 22 and print heads 24. In particular, receivers 26 are configured to move towards and away from one another from opposite sides of media support 22 and from opposite sides of print media supported by media support 32. In one embodiment, receivers 26 are movable between media support 22 and print heads 24 when print heads 24 or in the printing position (less than or equal to about 2 mm from media support 22 in one embodiment) with respect to media support 22. In another embodiment, receivers 26 may be configured to be moved between media support 22 and print heads 24 when print heads 24 are in a raised or elevated position with respect to media support 22 prior to printing. In one embodiment, receivers 26 are configured to move in substantial unison towards and away from one another. In yet another embodiment, receivers 26 may be configured to be moved independent of one another at different speeds or by different distances. In yet another embodiment, one of receivers 26 may be stationary while the other receiver 26 is movable.

According to one embodiment, receivers 26 are cantilevered relative to media support 22 between media support 22 and print head 24. In yet another embodiment, receivers 26 may include bearings interfacing between receivers 26 and media support 22 to support receivers 26 as they move across media support 22. For example, in one embodiment, receivers 26 may include wheels or slides that roll or slide within grooves or tracks associated with media support 22. In another embodiment, this relationship may be reversed where receivers 26 include guides or tracks and move along rollers or low friction surfaces associated with media support 22.

According to one embodiment, receivers 26 are removably supported and removably coupled to the structure or mechanism by which receivers 26 are operably connected to receiver drive 28. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members. For purposes of this disclosure, the term "removably coupled" means that a first structure may be removed or separated from a second adjacent connecting structures without severing, cutting, permanently deforming or otherwise damaging either the first structure or the second structure.

In one embodiment, each of receivers 26 may be removably coupled to receiver drive 28 by screws, bolts or other fasteners, permitting receivers 28 to be removed using tools. In another embodiment, each receiver 26 may be removably coupled to receiver drive 28 without the use of tools. For example, receivers 26 may be connected to structures associated with receiver drive 28 with a detent receiving a detent engaging projection and wherein the projector may be removed from the detent by resiliently flexing a catch, hook and a like by sliding a lock or pressing a pushbutton. In other embodiments, receivers 26 may be removably coupled to receiver drive 28 in other fashions. In one embodiment, receivers 26 are configured to be moved by receiver drive 28 to user accessible areas of printer 20, facilitating their removal. Because receivers 26 are removably coupled to receiver drive 28, receivers 26 may be dislodged and removed for cleaning, repair or replacement. In other embodiment, receivers 26 may alternatively not be removably coupled to receiver drive 28.

Receiver drive 28 comprises one or mechanism configured to move receivers 26 inwardly and outwardly relative to each other and between media support 22 and print heads 24. In one embodiment, receiver drive 28 comprises a single drive that drives both receivers 26. In the particular embodiment illustrated, receiver drive 28 is configured to concurrently drive or move receivers 26 in unison. In other embodiment, receiver drive 28 may include independent drives for independently driving receivers 26A and 26B.

As shown by FIG. 1, in the particular example illustrated, receiver drive 28 includes rack gear 46A and rack gear 46B (collectively referred to as rack gears 46), pinion gear 48 and rotary actuator 50. Rack gear 46A comprises a rack gear operably coupled to receiver 26A. Rack gear 46B comprises a rack gear operably coupled to receiver 26B. Pinion gear 48 comprises a pinion gear sandwiched between and in meshing engagement with both rack gear 46A and rack gear 46B. Rotary actuator 50 comprises a motor operably coupled to pinion gear 48 to selectively rotationally drive pinion gear 48 in either direction. In one embodiment, rotary actuator 50 comprises a stepper motor. In another embodiment, rotary actuator 50 may comprise other mechanisms configured to supply rotational torque for rotating pinion gear 48.

In operation, rotation of pinion gear 48 in a clockwise direction (as seen in FIG. 1) moves rack gear 46A to the right (as seen in FIG. 1) and moves rack gear 46B in an opposite direction to the left (as seen in FIG. 1). In the particular embodiment illustrated, this results in receivers 26 moving towards one another. Alternatively, rotation of pinion gear 48 in a counterclockwise direction(as seen in FIG. 1) moves rack gear 46A to the left (as seen in FIG. 1) and moves rack gear 46B in an opposite direction to the right (as seen in FIG. 1). In the particular embodiment illustrated, this results in receivers 26 moving away one another. In other embodiment, receiver drive 28 may be operably coupled to receivers 26 in an opposite fashion such that the noted movement of racket gears 46 moves receivers 26 in opposite directions relative to one another.

In other embodiments, receiver drive 28 may have other configurations. For example, in another embodiment, receiver drive 28 may be provided by one or more hydraulic or pneumatic cylinder assemblies, one or more electric solenoids or one or more belt and pulley arrangements, wherein receivers 26 are connected to the belts to be linearly moved towards away from one another. In still other embodiments, receiver drive 28 may comprise other mechanisms configured to controllably move receivers 26.

Sensors 29 comprises sensing devices configured to identify to controller 34 the state of receiver drive 28 and the positioning of receivers 26. In the embodiment illustrated, sensor 29A comprises a rotary encoder while sensor 29B comprises a linear encoder in other embodiment, other sensors may be employed such as emitter-detector sensors, Hall effect sensors and the like. Signals from sensors 29A and 29B are used by controller 34 as feedback to accurately control positioning of receivers 26. In other embodiment, sensors 29 may be provided other locations. In particular embodiment, sensors 29 may be omitted.

Collectors 30 comprise containers or other structures configured to hold and collect ink, fluid or other printing material removed from receivers 26 by wipers 32. In one embodiment, collector 30 each comprise basins having a floor and sidewalls. In another embodiment, collectors 38 additionally include absorptive material for absorbing the received fluid. For example of the absorptive material may be a foam, sponge, fabric or porous material. In particular embodiments, collectors 30 may consist of an absorptive member without the basin. In one embodiment, collectors 30 are each removably supported and removably coupled to an associated frame or other supporting structure of printer 20 (not shown). As a result, collectors 30 may be dislodged from printer 20 for removal of the collected ink or other printing material, for discarding them or for replacement. In embodiments where printer 20 omits wipers 32, collectors 30 may be omitted.

Wipers 32 comprise mechanisms configured to wipe, brush or scrape ink or fluid collected within receivers 26. Each of wipers 32 includes a wiper blade 54 and an actuator 56. Wiper blade 54 scrapes or wipes ink from the floor of trough 26. Wiper blade 54 is movable between a wiping position (shown in FIG. 3) and a withdrawn position (shown in FIGS. 1 and 2). In other embodiments, wiper blade 54 may alternatively comprise a brush, an absorbent member, a blower or a vacuum to facilitate removal of fluid or other printing material from the associated receiver 26.

Actuator 56 comprises mechanisms configured to selectively move wiper blade 54 between the wiping or cleaning position and the withdrawn position. In one embodiment, actuator 56 is configured to linearly move blade 54 up-and-down. In another embodiment, actuator 56 may be configured to pivot blade 54 between the wiping or cleaning position and the withdrawn position. In one embodiment, actuator 56 may comprise a hydraulic or pneumatic cylinder assembly or an electric solenoid. In yet another embodiment, actuator 56 may comprise a driven cam arrangement or other mechanisms. In other embodiments, actuator 56 and/or wiper blade 54 may be omitted.

Controller 34 comprises one or more processing units configured to generate control signals directing operation of media support 22, print heads 24, receiver drive 28 and actuators 56. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 34 may be embodied as part of one or more application-specific integrated circuits (ASICs). Unless otherwise specifically noted, the controller is not limited to any specific combination of hardware circuitry and software, nor to any particular source for the instructions executed by the processing unit.

FIGS. 1-3 illustrate three modes of operation for printer 20. FIG. 1 illustrates printer 20 printing upon a medium 36A having a width W1. As shown by FIG. 1, the one or more print heads 24 have a collective width greater than width W1. As a result, not all of nozzles 38 are used to print the image 60 upon medium 36A. In particular, during printing of the image 60, a first extent 62 of nozzles 38 are used to print the image 60 while the remaining extents 64A and 64B are not used for printing image 60. If the unused extent 64 of nozzles 38 is not fired, the ink or other fluid in such nozzles may dry out and they be difficult to recover at a later time. This may result in subsequent print head failure.

To facilitate maintenance of such extents 64A and 64B, controller 34 generates control signals directing actuator 50 to rotate pinion gear 48 and thereby move receivers 26 such that receivers 26 are located opposite to those extents 64A and 64B which will not be used when printing upon medium 36A. Once receivers 26 have been properly located with respect to print had 24, controller 34 generates control signals directing media support 22 and print head 24 to print image 60. In particular, extent 62 of nozzles 38 ejects fluid onto medium 36A to form image 60. At substantially the same time (i.e. during the overall printing of image 60) controller 34 also generates control signals directing the unused extents 64A and 64B to fire or eject ink or fluid into receivers 26, maintaining the health of the unused extents 64A,64B of nozzles 38. In particular examples, controller 34 may generate control signals such as some of the nozzles 38 of extents 64A and 64B enable edge-to-edge printing of image 60 upon medium 36A, such as with borderless printing.

FIG. 2 illustrates printer 20 printing upon a medium 36B having a smaller width W2. The smaller width of medium 36B may be sensed by one or more sensors (not shown) or such information may be input to printer 20. Given the known smaller width W2 of medium 36B, controller 34 generates control signals directing rotary actuator 50 to appropriately drive pinion gear 48 (shown in FIG. 1) so as to move receivers 26 further inward towards one another as indicated by arrows 68. Once receivers 26 are properly positioned with respect to print heads 24, controller 34 generates control signals directing media support 22 and print heads 24 to print image 70 upon medium 36B. In particular, controller 34 (shown in FIG. 1) generates control signals directing used or active extent 72 of nozzles 38 to eject fluid or ink so as to form an image 70. At the same time, controller 34 generates control signals directing the unused extents 74A and 74B of nozzles 38 of print heads 24 to fire, spit or eject ink or fluid into receivers 26A and 26B, respectively. As a result, the health of those nozzles 38 of extents 74A, 74B is maintained and borderless printing is facilitated.

As shown by FIGS. 1 and 2, because receivers 26 are movable, receiver 26 may be moved to accommodate different media having different widths. As noted above, media 36A, 36B may comprise sheets of media having different widths or may comprise webs of media having different widths. As a result, different extents 62, 72 of nozzles 38 may be used during printing upon the different media by different extents 64, 74 of unused nozzles 38 may be fired to preserve their health.

According to one embodiment, controller 34 automatically generates control signals appropriately positioning receivers 26 four the particular media being printed upon. In particular, controller 34 uses signals from sensors 23 to identify the width of the medium being printed upon. Based upon such information, controller 30 for a just positioning of receivers 26. In another embodiment, controller 34 may move receivers 26 between preset or predetermined positions preset for specific media widths in response to commands received via input 35. In still other embodiments, controller 34 may move receivers 26 between a continuum of positions in response to direct control by an operator via input 35. In some embodiments where media drive 28 is omitted, receivers 28 may be manually positioned relative to one another.

FIG. 3 illustrates a third mode of printer 20: wiping and receiver removal. The wiping mode may be initiated by controller 34 in response to an amount of ink or fluid collected in one or both of receivers 26, as detected by one or more sensors (not shown), exceeding a predetermined threshold, may be initiated by controller 34 in response to commands or instructions from a user of printer 20 or may be initiated by controller 34 automatically at predetermined time intervals, after a predetermined number of sheets or length of web of media have been printed upon or after a predetermined amount of ink or other fluid has been ejected by print heads 24. In another embodiment, the wiping mode may be initiated in other fashions.

As shown by FIG. 3, to initiate wiping, controller 34 generates control signals directing motor 50 to appropriately drive pinion gear 48 (shown in FIG. 1) so as to move receivers 26 outwardly away from one another such that inner ends 76 of receivers 26 extend in close proximity to wiper blades 54. As indicated by arrows 78, controller 34 (shown in FIG. 1) further generates control signals directing actuators 56 to move wiper blades 54 to their wiping positions in which blades 54 extend into receivers 26. In one embodiment, such blades contact a floor of receivers 26 when in the wiping position. Once wiping blades 54 are appropriately positioned with respect to receivers 26, controller 34 generates control signals directing motor 50 to drive pinion gear 48 (shown in FIG. 1) to move receivers 26 towards one another in the directions indicated by arrows 80. As a result, as indicated by arrows 82, ink, fluid or other dried ejected material within receivers 26 is pushed across the floor of receivers 26 and out outer ends 84 of receivers 26 into or onto collectors 30. In one embodiment, ends 84 receivers 26 may be upwardly ramped or sloped so as to contain received ink within receivers 20 while also permitting blades 54 to push and eject the collected ink or other fluid over such ramped ends 84.

In the example illustrated, wiping of receivers 20 is facilitated using the same receiver drive 28 used to reposition receivers 26 for receiving ink spit from the unused extents of nozzles 38. As a result, cost and complexity a printer 20 is reduced. In other embodiments, other independent drives may use to move receivers 26 to facilitate such wiping. In still other embodiments, receivers 26 may alternatively be substantially stationary as wiper blades 54 (or brushes or absorbent material) are moved across receivers 26 by actuators 56 or other drive mechanisms. As noted above, in some embodiments where receivers 26 are removed, discarded and replaced with fresh, empty receivers 26, wipers 32 may be omitted. Likewise, collectors 30 may also be omitted.

In the position shown in FIG. 3, receivers 26 are withdrawn from between the print heads 24 and media support 22. As a result, receivers 26 may be more easily accessed by persons using printer 20. In such positions, receivers 26 may be more easily decoupled from receiver drive 28 for removal and cleaning or replacement. Cleaned or replacement receivers 26 may also be more easily reattached to receiver drive 28.

Although the description of the three modes above has been in the context of a receiver drive 28 including rack gears 46, pinion gear 48 and rotary actuator 50, wherein control signals from controller 34 direct operation of actuator 50, in other embodiments, other receiver drives 28 may also be employed. In such alternative embodiments, controller 34 may alternatively generates control signals directing such alternative receiver drives to move receivers 26 as desired. As noted above, in other embodiments, controller 34 may generate control signals directing two distinct receiver drives for independently moving receivers 26.

Figure 4:
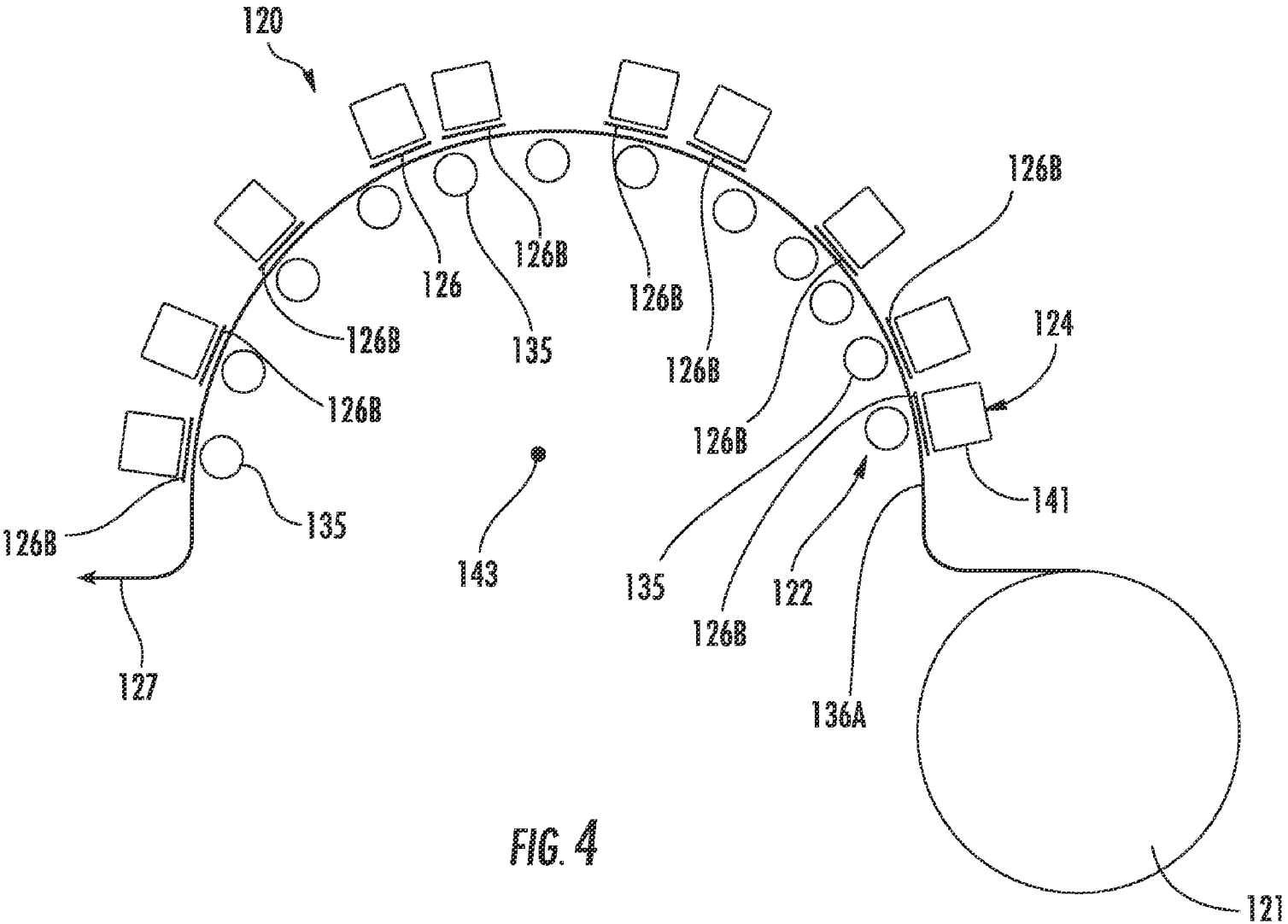
FIG. 4 is a side elevational view schematically illustrating another embodiment of the printer of FIG. 1.

FIG. 4 schematically illustrates printer 120, an example embodiment of printer 20 as shown in FIGS. 1-3. Printer 120 includes media supply 121, media support 122, print heads 124, receivers 126A, 126B (shown in FIG. 6), receiver drive 28 (shown in FIG. 1), collectors 30 (shown in FIG. 1), wipers 32 (shown in FIG. 1) and controller 34 (shown in FIG. 1). Media supply 121 supplies media for being printed upon. In the example illustrated, media supply 121 comprises a roll of media, such as paper, supplying a web of the media which moves between media support 122 and print heads 124 as indicated by arrow 127.

Media support 122 comprises a structure or mechanism configured to support, move and position a print medium substantially opposite to the one or more print heads 24. In the example illustrated, media support 122 comprises a series of rollers 135 configured to rotate while supporting web 136A opposite to print heads 124. Web 136 is driven by one or more drive rollers (not shown) so as to maintain or control velocity as well as tension of web 136A. As shown by FIG. 4, rollers 135 are rotationally supported and arranged in an arc. As a result, web 136A is driven along an arc or circumferential path opposite to print heads 124. Because web 136A is supported along an arcuate path, print heads 124 may also be supported along an arc, facilitating more accurate control of print head to web spacing.

Figure 6:
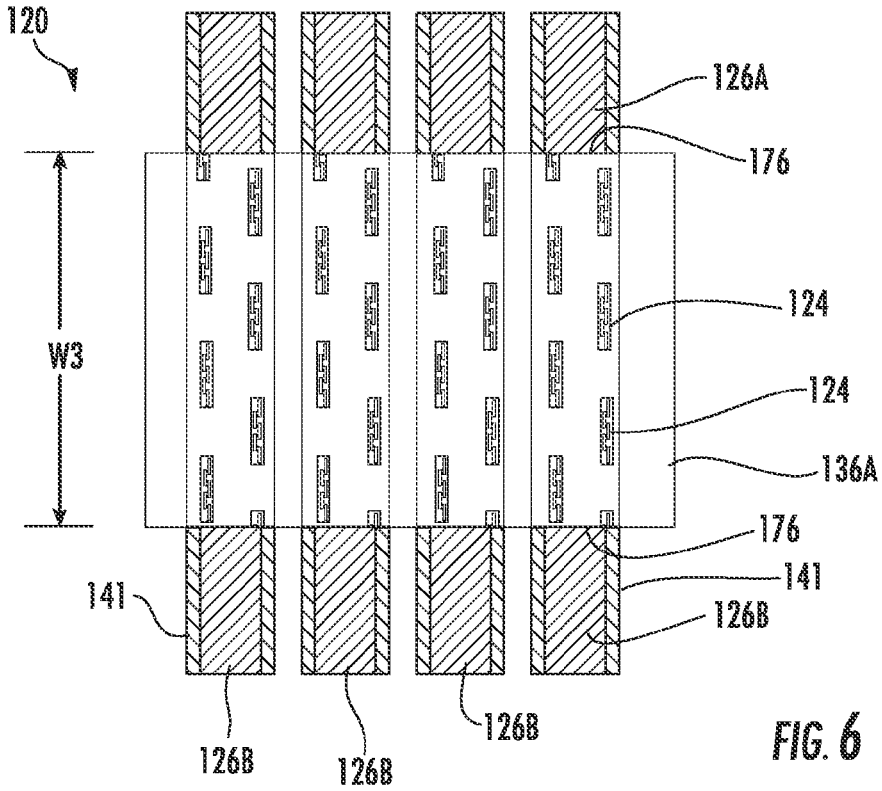
FIG. 6 is a bottom plan view of the printer of FIG. 4 during printing upon a third medium according to an example embodiment.

Print heads 124 include a multitude of nozzles 38 (schematically shown in FIG. 1) through which ink or other fluid is ejected onto a print medium, such as medium 136A to form an image upon the medium. As shown by FIG. 6, in the example illustrated, print heads 124 comprise a plurality of such print heads which are staggered with respect to one another in a direction across a width of the medium being printed upon. In the example illustrate, print heads 124 are provided by or supported by a plurality of distinct print bars 141. As further shown by FIG. 4, print bars 141 are arcuately or circumferentially arranged about media support 124. Each print bar 141 is supported such that its associated print heads 124 extend substantially parallel to the opposing medium upon which the particular print bar 141 prints. In other embodiments, print bars 141 may have other arrangements.

According to one embodiment, print bars 141 and their associated print heads 124 are fixed or stationary with respect to media support 122 in a direction substantially parallel to media support 122 and parallel to axis 143, the axis about which media support 122 and print bars 141 are arcuately or circumferentially arranged. In such an embodiment print heads 124 may be movable in a direction substantially perpendicular to media support 122 or may also be fixed against movement in directions substantially perpendicular to media support 24 (up and down as seen in FIG. 4). In some embodiments, media support 124 may be configured to be scanned across the medium.

Receivers 126A and 126B (collectively referred to as receivers 126) are substantially similar to receivers 26A and 26B. Receivers 126A, 126B comprise one or more structures configured to receive and collect ink or other fluid ejected from nozzles 38 of print heads 124. In one embodiment, receivers 126 may comprise basins having a floor and one or more sidewalls that collect the ejected fluid. In another embodiment, receivers 126 may additionally include absorptive material within or on the basin for absorbing the received fluid. Examples of absorptive material include a foam, sponge, fabric or porous material.

In yet other embodiments, receivers 126 may consist of blocks, pads or other structures of the absorbent material or materials alone. For example, in one embodiment, receivers 26 may comprise pads, blocks or structures of a fabric, sponge or foam material. In addition to receiving ink or fluid ejected from some of nozzles 138 of print heads during printing, the bottom side of such receivers 126 may also contact portions of media support 122 when being moved relative to media support 122 or during movement of media support 122 relative to receivers 126 during printing to wipe or remove residue ink or other fluid that may have collected upon media support 122. Such ink may have collected upon media support 122 during borderless printing.

As shown in FIG. 6, receivers 126A and 126B extend an opposite sides of media support 122 and on opposite sides of print bars 141. As shown in FIG. 4, a receiver pair (receivers 126A and 126B) is provided for each print bar 141. The pairs of receivers 126A and 126B extend between each print bar 141 and media support 122. The pairs of receivers 126A and 126B are arcuately or circumferentially arranged about axis 143.

As with receivers 26, receivers 126 are each movably supported relative to media support 122 and print heads 124. In particular, receivers 126 are configured to move towards and away from one another from opposite sides of media support 122 and from opposite sides of print media supported by media support 132. In one embodiment, receivers 126 are movable between media support 122 and print heads 124 when print heads 124 are in the printing position (less than or equal to about 2 mm from media support 122 in one embodiment) with respect to media support 122. In another embodiment, receivers 126 may be configured to remove between media support 122 and print heads 124 when print heads 124 are in a raised or elevated position with respect to media support 122 prior to printing. In one embodiment, receivers 126 are configured to move in substantial unison towards and away from one another. In yet another embodiment, receivers 26 may be configured to be moved independent of one another at different speeds or by different distances. In yet another embodiment, one of receivers 126 may be stationary while the other of receivers 126 is movable.

According to one embodiment, receivers 126 are cantilevered relative to media support 122 between media support 122 and print head 124. In yet another embodiment, receivers 126 may include bearings interfacing between receivers 126 and media support 122 to support receivers 126 as they move across media support 122. For example, in one embodiment, receivers 126 may include wheels or slides that roller slide within grooves or tracks associated with media support 122. In another embodiment, this relationship may be reversed where receivers 26 include guides or tracks and move along rollers or low friction surfaces associated with media support 122.

According to one embodiment, receivers 126 are removably supported and removably coupled to the structure a mechanism by which receivers 126 are operably connected to receiver drive 28. In one embodiment, each of receivers 126 may be removably coupled to receiver drive 28 by screws, bolts or other fasteners, permitting receivers 128 to be removed using tools. In another embodiment, receivers 126 may be removably coupled to receiver drive 28 without the use of tools. For example, receivers 126 may be connected to structures associated with receiver drive 28 with a detent receiving a detent engaging projection and wherein the projection may be removed from the detent by resiliently flexing a catch, hook and the like by sliding a lock or pressing a pushbutton. In other embodiments, receivers 126 may be removably coupled to receiver drive 28 in other fashions. In one embodiment, receivers 126 are configured to be moved by receiver drive 28 to user accessible areas of printer 120, facilitating their removal. Because receivers 126 are removably coupled to receiver drive 28, receivers 126 may be dislodged and removed for cleaning, repair or replacement. In other embodiments, receivers 26 may alternatively not be removably coupled to receiver drive 28.

Receiver drive 28, collectors 30 and wipers 32 are each shown and described above with respect to FIGS. 1-3. In one embodiment, each receiver pair (126A, 126B) associated with each print bar 141 has its own dedicated set of collectors and wipers end utilizes a dedicated receiver drive 28 for moving the associated receiver pair inward and outward depending upon a width of the media to be printed upon. In other embodiments, two or more of the receiver pairs (126A, 126B) may share collectors 30 and a receiver drive 28. For example, a single collector 30 may extend proximate to wipers 32 of two consecutive receiver pairs. A single receiver drive 28 may be operably coupled to all the receivers 126 of two or more receiver pairs. For example, two receivers 126A may be operably coupled to rack gear 46A while two receivers 126B are operably coupled to rack gear 46B, reducing complexity and cost.

Figure 5:
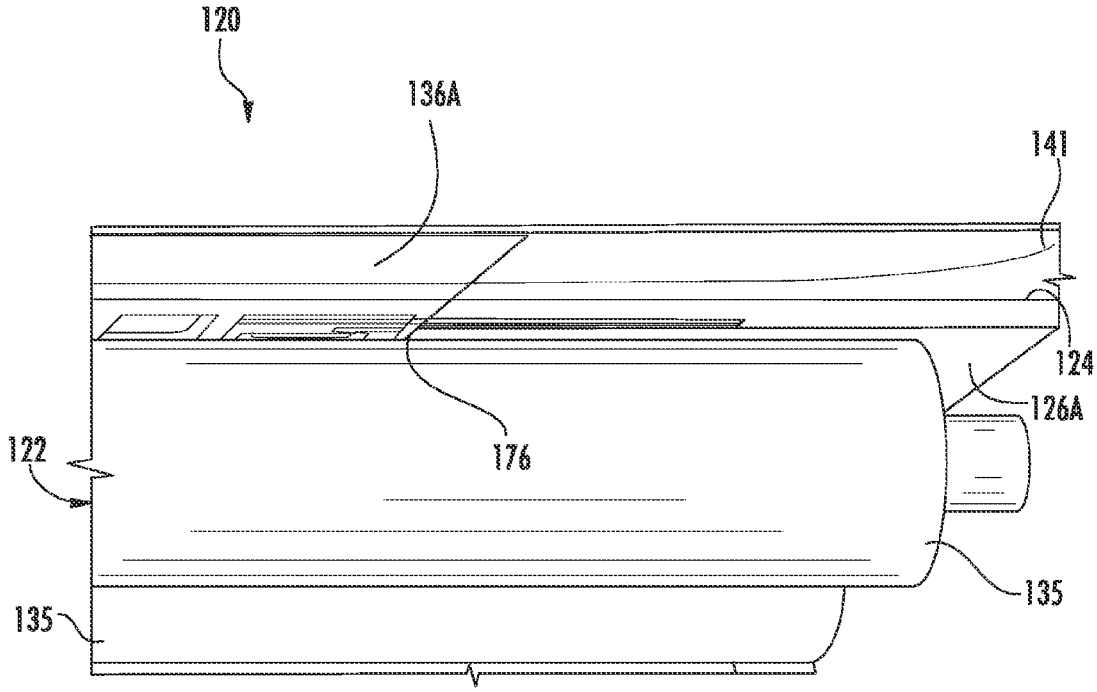
FIG. 5 is a fragmentary perspective view of the printer of FIG. 4 according to an example embodiment.
Figure 7:
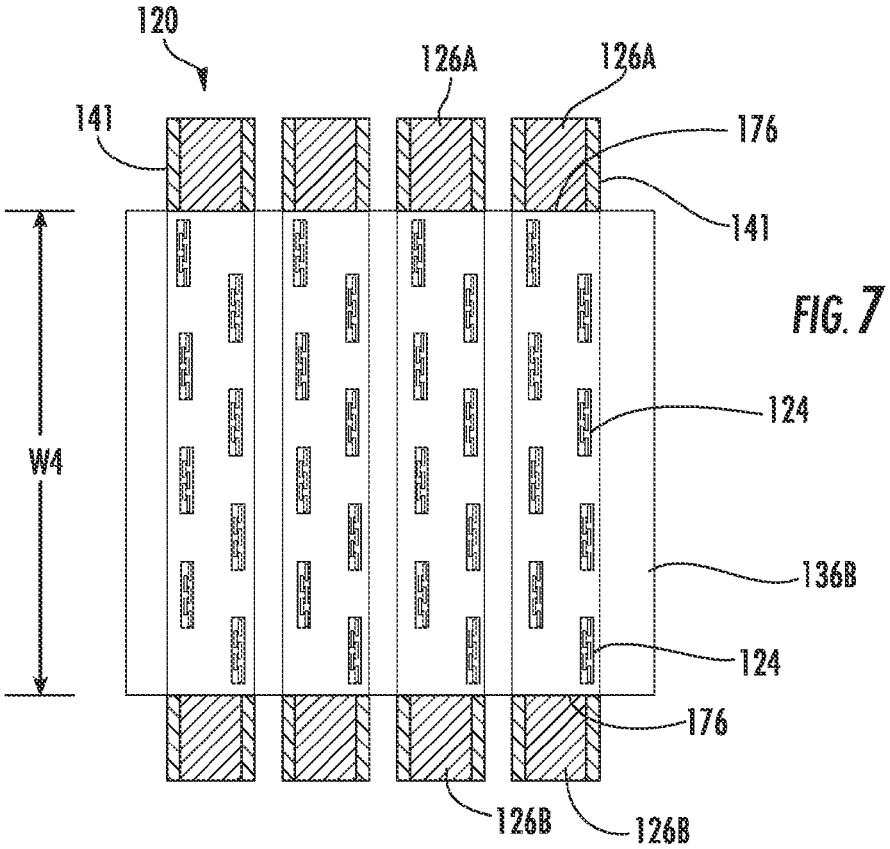
FIG. 7 is a bottom plan view of the printer of FIG. 4 during printing upon a fourth medium according to an example embodiment.

FIGS. 5-7 illustrate two example positions of receivers 126 to accommodate webs 136A and 136B of media having different widths. FIG. 5 illustrate receivers 126A and 126B positioned by receiver drive 28 (shown in FIG. 1) between rollers 135 and one of print bars 141. As shown by FIGS. 5 and 6, receivers 126A and 126B are moved such that inner ends 176 of receivers 126A and 126B are spaced from one another by a distance substantially equal to the width W3 of the web of media 136A. As shown in FIG. 5, in one embodiment, receiver 126A is moved inwardly towards the web of media 136A such that the inner end 176 of receiver 126A extends in substantially the same plane as the web and extends into close proximity or even abuts web 136A. Receiver 126B is similarly positioned. During printing, fluid rejected by those print heads 124 opposite to the web of media 136A is deposited upon medium 136A to form an image. At substantially the same time, fluid ejected by those print heads 124 opposite to receivers 126 is received within receivers 126. Because those print heads 124 that do not form images upon the web of material 136A are permitted to be spit into receivers 126, the health of such unused nozzles is maintained. Borderless printing upon the web media 136A is also facilitated.

FIG. 7 illustrates receivers 126A and 126B moved to a second position between rollers or 135 of media support 122 and print heads 124 of print bars 141. In particular, FIG. 7 illustrates receivers 126A and 126B positioned such that their inner ends 176 are spaced from one another by a distance of approximately or substantially equal to the width W4 of a second distinct web of material 136B. In one embodiment, receiver 126A is moved inwardly towards the web of media 136B such that the inner end 176 of receiver 126A extends in substantially the same plane as the web and extends into close proximity or even abuts web 136B. Receiver 126B is similarly positioned. During printing, fluid ejected by those print heads 124 opposite to the web of media 136b is deposited upon media 136B to form an image. At substantially the same time, fluid ejected by those print heads 124 opposite to receivers 126 is received within receivers 126. Because those print heads 124 that do not form images upon the web of material 136B are permitted to be spit into receivers 126, the health of such unused nozzles is maintained. Borderless printing upon the web media 136B is also facilitated. Thus, as shown by FIGS. 6 and 7, the movability of receivers 126 enables printer 120 to accommodate different webs of material having different widths while maintaining nozzle health and facilitating borderless printing.

Figure 8:
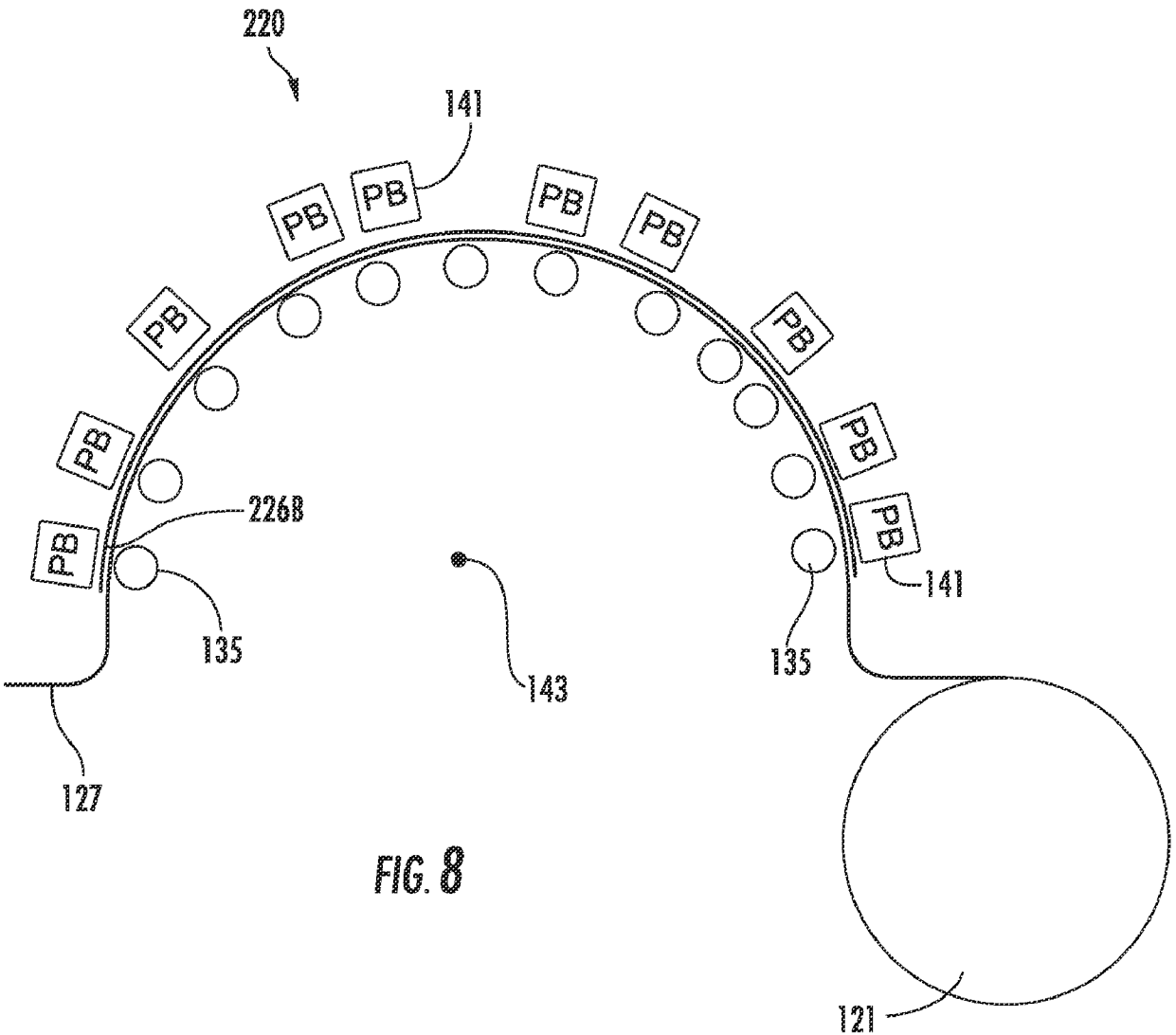
FIG. 8 is a side elevational view schematically illustrating another embodiment of the printer of FIG. 1.
Figure 9:
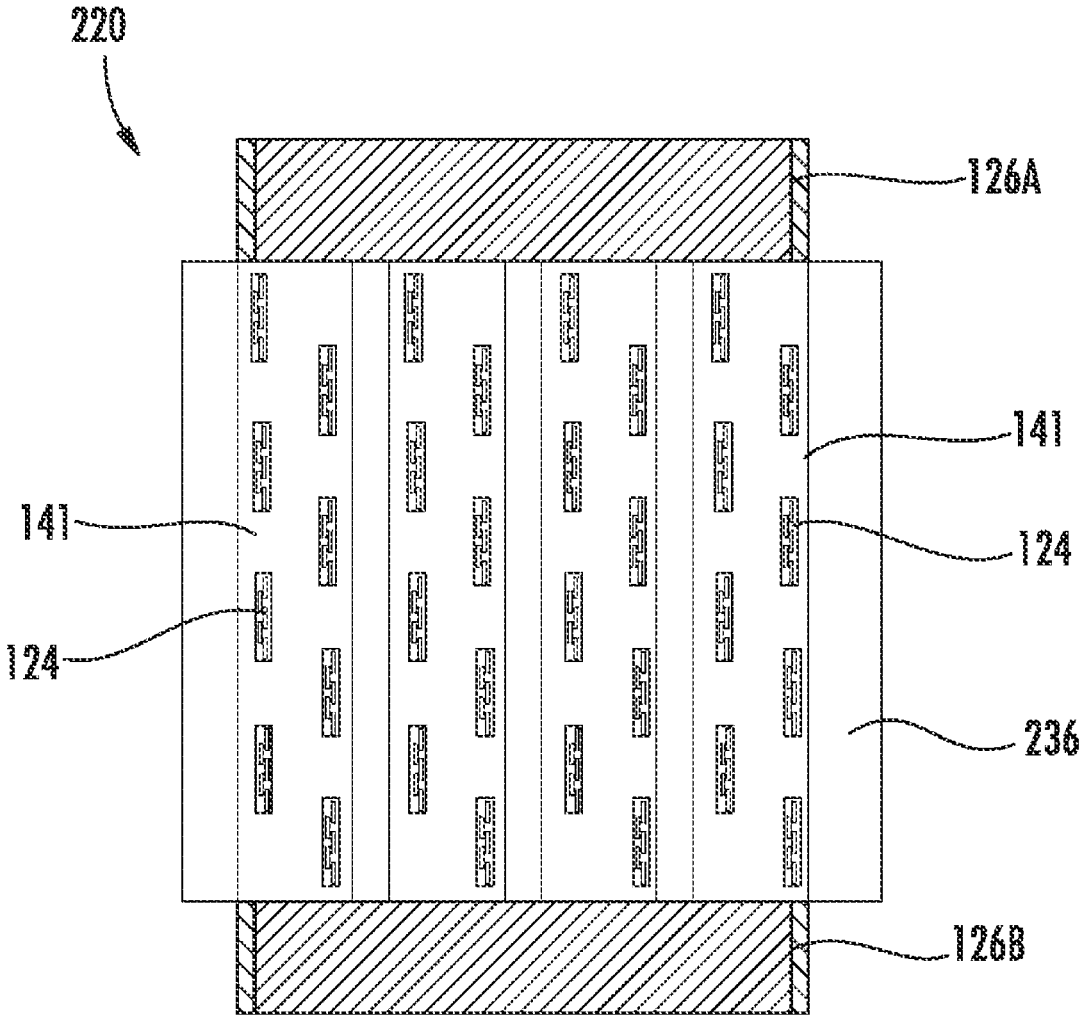
FIG. 9 is a bottom plan view of the printer of FIG. 8 during printing upon a medium according to an example embodiment.

FIGS. 8 and 9 illustrate printer 220, another embodiment of printer 120. Printer 220 is similar to printer 120 except that printer 220 includes a single pair of receivers 226A and 226B in place of the multiple pairs of receivers shown in FIGS. 5-7. Receivers 226A and 226B are similar to individual receivers 126A and 126B, respectively, except that receivers 226A and 226B extend opposite to and receive ejected fluid from a multitude of print heads 124 (shown in FIG. 9) associated with a multitude of print bars 141. In particular, each of receivers 226A and 226B arcuately or circumferentially extends about axis 143. As a result, complexity and cost of printer 220 is reduced.

As with receivers 126, receivers 226 are movable inward and outward with respect to one another between media support 122 and print bars 141 on opposite sides of web of media 236 by receiver drive 28 (shown in FIG. 1). In particular embodiment, printer 220 may additionally include a collector 30 and a wiper 32 (shown in FIG. 1) associated with each of receivers 226A and 226B. As with receivers 126, receivers 226 permit printer 220 to accommodate different web widths while maintaining nozzle health and facilitating borderless printing.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A printer comprising:

one or more print heads;

a media feed configured to feed media relative to the print heads;

a first receiver configured to receive fluid ejected by the one or more print heads along and beyond a first side of the media; and a second receiver configured to receive fluid ejected by the one or more print heads along and beyond a second opposite side of the media, wherein the second receiver is movable relative to the first receiver, wherein the one or more print heads extend in an arc about an axis and wherein at least one of the first receiver and the second receiver is movable with respect to the other of the first receiver and the second receiver along the axis.

2. The printer of claim 1, wherein the first receiver is movable relative to the second receiver.

3. The printer of claim 1, wherein the media feed is configured to feed a web of media.

4. The printer of claim 1, wherein the media feed includes a circumferential surface configured to contact the media in when the second receiver is movable within a gap between the surface and the one or more print heads.

5. The printer of claim 4, wherein the gap is less than or equal to 2 mm.

6. The printer of claim 1 further comprising:

a wiper blade associated with the second receiver; and an actuator configured to move the second receiver relative to the wiper blade such that the wiper blade removes the fluid from the second receiver.

7. The printer of claim 1, wherein the second receiver includes a wiper blade within the second receiver that is configured to remove fluid from the second receiver.

8. The printer of claim 1 further comprising a support configured to removably support the second receiver with respect to the media feed.

9. The printer of claim 1, wherein the at least one print head includes arcuately arranged and circumferentially spaced print bars, each print bar having multiple staggered print heads and wherein the printer includes a set of first side receivers including the first receiver on the first side of the print bars and a second set of second side receivers including the second receiver on the second side of the print bars.

10. The printer of claim 9, wherein the one or more print heads are configured to substantially concurrently print printing material into both the first receiver and the second receiver while printing upon media supported by the media feed.

11. The printer of claim 1 further comprising a controller configured to generate control signals, wherein the one or more print heads is configured to print upon media supported by the media feed while substantially concurrently printing print material into at least one of the first receiver and the second receiver in response to the control signals.

12. The printer of claim 1, wherein the at least one print head includes arcuately arranged and circumferentially spaced print bars, each print bar having multiple staggered print heads and wherein the first receiver is on a first side of the print bars and is configured to extend opposite to a plurality of the print bars and wherein the second receiver is on the second side of the print bars and is configured to extend opposite to the plurality of the print bars.

13. The printer of claim 1, wherein the at least one print head is stationarily fixed relative to the media drive.

14. A method comprising:

moving one or more receivers partially opposite to one or more print heads;

printing an image onto a print media while printing into the one or more receivers; and wiping print material from the one or more receivers.

15. The method of claim 14, wherein moving the one or more receivers comprises moving a first receiver towards or away from a second receiver, wherein the image is printed onto portions of the media extending between the first receiver and the second receiver.

16. The method of claim 14, wherein the one or more print heads are spaced from the print media by less than or equal to 2 mm during the printing of the imaging and printing into the one or more receivers.

17. The method of claim 14 further comprising feeding a web of the printing material across the one or more print heads.

18. The method of claim 14, wherein the one or more print heads extend in an arc about an axis and wherein at least one of the one or more receivers is movable with respect to the other of the one or more receivers along the axis.

19. A printer comprising:

one or more print heads;

a media feed configured to feed media relative to the print heads;

a first receiver configured to receive fluid ejected by the one or more print heads along and beyond a first side of the media;

a second receiver configured to receive fluid ejected by the one or more print heads along and beyond a second opposite side of the media, wherein the second receiver is movable relative to the first receiver;

a wiper blade associated with the second receiver; and an actuator configured to move the second receiver relative to the wiper blade such that the wiper blade removes the fluid from the second receiver.

20. A printer comprising:

one or more print heads;

a media feed configured to feed media relative to the print heads;

a first receiver configured to receive fluid ejected by the one or more print heads along and beyond a first side of the media;

a second receiver configured to receive fluid ejected by the one or more print heads along and beyond a second opposite side of the media, wherein the second receiver is movable relative to the first receiver and wherein the second receiver includes a wiper blade within the second receiver that is configured to remove fluid from the second receiver.

* * * * *